US008172206B2

(12) United States Patent
St. Lawrence

(10) Patent No.: US 8,172,206 B2
(45) Date of Patent: May 8, 2012

(54) SYSTEM FOR FORMING MINI MICROBUBBLES

(76) Inventor: Thomas St. Lawrence, Lake Jackson, TX (US)

( * ) Notice: Subject to any disclaimer, the term of this patent is extended or adjusted under 35 U.S.C. 154(b) by 447 days.

(21) Appl. No.: 12/466,316

(22) Filed: May 14, 2009

(65) Prior Publication Data

US 2010/0213113 A1 Aug. 26, 2010

Related U.S. Application Data

(60) Provisional application No. 61/055,716, filed on May 23, 2008.

(51) Int. Cl.
*B01F 3/04* (2006.01)

(52) U.S. Cl. ..... 261/93; 210/219; 210/220; 210/242.1; 210/242.2

(58) Field of Classification Search ..... 261/87, 261/91, 93, 120; 210/219, 220, 221.1, 221.2, 210/242.1, 242.2
See application file for complete search history.

(56) References Cited

U.S. PATENT DOCUMENTS

| | | | | | |
|---|---|---|---|---|---|
| 2,521,396 | A | * | 9/1950 | Moui | 261/93 |
| 2,944,802 | A | * | 7/1960 | Daman | 261/87 |
| 3,503,593 | A | * | 3/1970 | Nelson | 261/29 |
| 3,642,257 | A | * | 2/1972 | Tanaka et al. | 261/93 |
| 3,984,001 | A | * | 10/1976 | Nagano et al. | 209/3 |
| 4,066,722 | A | * | 1/1978 | Pietruszewski et al. | 261/87 |
| 4,086,306 | A | * | 4/1978 | Yoshinaga | 261/93 |
| 4,133,850 | A | * | 1/1979 | Hauser | 261/93 |
| 4,310,437 | A | * | 1/1982 | Schreiber | 96/177 |
| 4,521,349 | A | * | 6/1985 | Weber et al. | 261/93 |
| 5,194,144 | A | | 3/1993 | Blough | |
| 5,451,348 | A | * | 9/1995 | Kingsley | 261/36.1 |
| 5,458,816 | A | * | 10/1995 | Ebner et al. | 261/64.1 |
| 5,676,889 | A | | 10/1997 | Belgin | |
| 5,988,600 | A | * | 11/1999 | Vento | 261/29 |
| 6,145,815 | A | * | 11/2000 | Cheng et al. | 261/93 |
| 6,245,237 | B1 | | 6/2001 | Blough et al. | |
| 6,254,066 | B1 | | 7/2001 | Drewery | |
| 6,461,500 | B1 | | 10/2002 | Hoage et al. | |
| 6,655,663 | B2 | * | 12/2003 | Vento | 261/29 |
| 7,028,992 | B2 | * | 4/2006 | Rajendren | 261/28 |
| 7,241,615 | B2 | | 7/2007 | St. Lawrence | |
| 7,306,722 | B1 | | 12/2007 | Hoage | |
| 2006/0151897 | A1 | * | 7/2006 | Melen et al. | 261/93 |
| 2008/0118946 | A1 | | 5/2008 | Fabiyi et al. | |

FOREIGN PATENT DOCUMENTS

| | | | |
|---|---|---|---|
| JP | 56-31434 | A * | 3/1981 |
| JP | 06233922 | A | 8/1994 |
| JP | 2002166291 | A | 6/2002 |

* cited by examiner

*Primary Examiner* — Richard L Chiesa
(74) *Attorney, Agent, or Firm* — Egbert Law Offices PLLC

(57) ABSTRACT

A system for forming mini microbubbles has a motor, a shaft attached to the motor, a displacer attached to the shaft for mixing a media with a liquid, a discharge plate positioned adjacent the displacer, a housing adjustably attached to the discharge plate, and a media chamber fluidly connected with the discharge plate. The motor rotates the shaft. The discharge plate has a discharge hole formed therein. The media chamber is fluidly connected to the discharge hole of the discharge plate. The discharge plate is positioned between the motor and the displacer. The displacer is positioned within the housing. The media chamber can be positioned between the motor and the discharge plate.

20 Claims, 4 Drawing Sheets

SYSTEM FOR FORMING MINI MICROBUBBLES

RELATED U.S. APPLICATIONS

The present application claims priority from Provisional Patent Application No. 61/055,716, filed on May 23, 2008, and entitled, "SYSTEM FOR FORMING MINI MICROBUBBLES."

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to systems having optional delivery of multiple and mixed-phase media into liquids using partial vacuum control. Particularly, the present invention relates to systems that form mini microbubbles. More particularly, the present invention relates to aeration systems. Additionally, the present invention relates to enhancing the biological treatment of liquids.

2. Description of Related Art Including Information Disclosed Under 37 CFR 1.97 and 37 CFR 1.98.

Mixing, by introducing media, such as a gas or a solid or a liquid or a combination thereof, to a liquid is a common practice when treating liquids such as fresh water, salt water and all types of waste water. As an example, aeration by the introduction of atmospheric air containing oxygen into water is one of the most common methods used to biologically support the aerobic treatment of these liquids. Aerobic treatment of carbonaceous waste requiring an adequate supply of oxygen is much more efficient than anaerobic treatment of carbonaceous waste.

The introduction of various combinations of other gases, liquids, and solids into these liquids is often desirable and beneficial. A variety of biological inoculations and chemical supplements are often used to affect microbial activity and adjust chemical levels. While chlorination is commonly used in fresh water purification, nutrient additions to wastewater microbial cultures are similarly used to regulate and adjust levels of carbon, nitrogen and phosphorous. The chemical oxidation and reduction of compounds in a liquid such as water to accomplish de-nitrification and phosphorous remediation are also common. Desirable biological, chemical and physical activity results in problematic foaming that accumulates on a liquid surface, interferes with normal apparatus operation, and can present a nuisance.

Aerators are used to treat a wide variety of liquids and liquid volumes for a wide variety of applications. Examples of such uses include treating aquariums, septic tanks, ponds, process tanks, municipal treatment plants, lagoons, streams, lakes and oceans.

The use of microbubbles filled with atmospheric air as their media has been used to provide an effective treatment for beneficial aerobic microbial remediation. The liquid under treatment can have conditions requiring mixing, quiescence, or a combination thereof. When larger bubbles are formed, they rapidly rise to the surface of a liquid and gain in volume as the liquid pressure decreases while the bubbles rise. These larger bubbles may be captured at various depths and reprocessed into smaller bubbles. Smaller bubbles remain in liquid for a longer period of time, impart less mixing, and are moved by eddy currents and the Brownian movement of liquids. A mini microbubble is smaller than a microbubble, remains in liquid longer than a microbubble, and imparts a milky appearance to liquids. Mini microbubbles easily flow, rapidly diffuse, and linger within a liquid. Mini microbubbles also have more surface area than larger bubbles. Because gas transfer to liquids is a function of the ratio of surface area to volume, the smaller mini microbubbles have a greater transfer potential and are better for aeration. Thus, there is a need for systems that can create mini microbubbles for the treatment of a liquid.

Creation of a partial vacuum under water can be achieved with displacement of a liquid media. Such measures have been used in prior art to produce a mixture of bubbles of various sizes. Managing the dynamic fluid forces that occur during the mixing, or in particular, during aeration is important in order to produce optimum bubble sizes. Methods using a partial vacuum source to collectively select media from different depths in a liquid at specific points, visibly observe, or hold for sampling, have been used. Methods to dispense media positioned above, in or below the liquid surface are also known and used.

A quantity of gas, such as air, that is released into water under a partial vacuum creates an unstable bubble, termed a "vacuum bubble," which rapidly adjusts its volume until its pressure reaches equilibrium. Thus, a system for precisely controlling the size, quality and quantity of gas bubbles by using the partial-vacuum variables of pressure and volume based one the Gas Law $P1V1=P2V2$ is needed.

Various patents have issued related to aeration systems. For example, U.S. Pat. No. 5,194,144, issued on Mar. 16, 1993 to Blough, discloses an improved aeration device for septic tanks which allows fine bubbles of air to aerate waste material in the tank so that aerobic bacteria may fully perform their decomposing function. Air enters the upper end of a shaft and exists adjacent a propeller. The propeller is protected from interfering with its bubble formation action by a guard bushing concentrically positioned in the air tube so that typical non-organic waste adulterants, such as plastic and rubber materials that are often found in septic tanks, are not drawn into the propeller to interfere with its action.

U.S. Pat. No. 5,676,889, issued on Oct. 14, 1997 to Belgin, discloses an apparatus for aerating and mixing liquids and gases that includes a hollow housing, at least one rotating object, a rotating apparatus for rotating the rotating object, a shaft, and at least one adjustably positioned conduit tube. The hollow housing has a hollow-housing first portion and a hollow-housing second portion. The hollow-housing first portion has a hollow-housing first-portion wall that contains at least one hollow-housing first-portion wall-inflow port and the hollow-housing second portion has a hollow-housing second-portion wall that contains at least one hollow-housing second-portion wall-outflow port. The rotating object is located in the hollow-housing second portion and has a rotating-object low-pressure side. The rotating apparatus rotates the rotating object and is located in the hollow-housing first portion. The shaft connects the rotating object to the rotating apparatus. The adjustably-positioned conduit tube passes through the hollow-housing first-portion wall-inflow port and has a conduit-tube first end externally located from the hollow housing. The conduit tube also has a conduit-tube second end located in the rotating-object low-pressure side so that, upon rotation of the rotating object, a substance can be drawn from the conduit-tube first end to the rotating-object low-pressure side.

U.S. Pat. No. 6,245,237, issued on Jun. 12, 2001 to Blough et al., discloses an improved method for aeration of septic tanks and the like by drawing atmospheric air into an expansion chamber, and from there, into agitated sludge to provide low-pressure small microbubbles which have long hold times in the sludge material.

U.S. Pat. No. 6,254,066, issued on Jul. 3, 2001 to Drewery, discloses an apparatus for aerating liquid in a wastewater treatment tank having a submergible motor with a shaft extending outwardly therefrom, a supporting member affixed to the submergible motor and adapted to maintain the submergible motor in a position within the liquid in the wastewater treatment tank, a propeller affixed to the shaft of the submergible motor, a housing extending around the propeller and the shaft, and an air tube connected to the housing and adapted to pass air interior of the housing between the propeller and the motor. The housing has a tubular configuration with a diameter slightly greater than the diameter of the propeller. The housing will extend beyond an end of the propeller opposite the shaft. The air tube extends so as to have one end affixed to the housing and communicate with an interior of the housing at an opposite end opening to an area outside of the liquid in the wastewater treatment tank.

U.S. Pat. No. 6,461,500, issued on Oct. 8, 2002 to Hoage et al., discloses an improved method and apparatus for aeration of septic tanks and the like. Because of the interrelationship of the rotating impeller, an air plate, and the horsepower of the unit in comparison with the volumetric size of the sludge tank, the unit disperses extremely small reduced-pressure microbubbles adjacent the area of the impeller. These reduced pressure microbubbles are thereafter dispersed throughout the wastewater by Brownian movement without agitating the sludge. As a result, there is substantially increased lateral oxygen transfer to replace the oxygen used by the aerobic bacteria. The sludge is therefore efficiently digested without the need for huge, expensive and energy-inefficient equipment.

U.S. Pat. No. 7,241,615, issued on Jul. 10, 2007 to St. Lawrence, discloses a wet combustion engine that has a wet combustion chamber within a bioproactor system, an integrated computer control system that, proactively and preemptively, uses feedback from bio-sensors to monitor, record, and control applicable components of the bioproactor system, and a wet combustion diffusion separation-membrane chamber located within a life-support chamber of the bioproactor. In the intake cycle, a suitably prepared fuel mixture is metered into the wet combustion diffusion separation membrane chamber located within the life-support chamber of the bioproactor. In the combustion cycle, diffusion and combustion rates are monitored and timed. In the exhaust cycle, products of combustion, including water and incomplete combustion by-products both organic and inorganic, are removed.

U.S. Pat. No. 7,306,722, issued on Dec. 11, 2007 to Hoage, discloses an improved apparatus and method to increase lateral oxygen transfer in wastewater which eliminates rotating impellers and air plates. As a result, less horse power per unit can be used to achieve smaller entrained air bubbles resulting in increased residence time and enhanced lateral oxygen transfer to replace oxygen consumed by aerobic bacteria during the biodegradation process. It may be used on industrial waste water sources of all types which are biodegradable by aerobic bacteria.

It is an object of the present invention to mix at least one media with a liquid.

It is another object of the present invention to mix media with a liquid using partial vacuum pressure.

It is another object of the present invention to produce mini microbubbles that are smaller than microbubbles.

It is still another object of the present invention to produce optimal mini microbubbles for any given media and liquid combination.

It is another object of the present invention to create long-lasting mini microbubbles.

It is another object of the present invention to remove odor and solids from waste water.

It is another object of the present invention to chemically treat liquids, such as water.

It is still another object of the present invention to transfer gases, such as dissolved oxygen, in aquaculture.

It is another object of the present invention to deliver, monitor, and control combinations of media, including gases and liquids and solids, with or without mixing.

It is another object of the present invention to use chemical and physical processes that benefit from enhanced dissolution, catalytic combinations, extractions, and remediation.

These and other objects and advantages of the present invention will become apparent from a reading of the attached specification and appended claims.

BRIEF SUMMARY OF THE INVENTION

The present invention is a system for forming mini microbubbles comprising a drive means, a shaft attached to the drive means, a displacing means attached to the shaft for mixing a media with a liquid, a discharge plate positioned adjacent the displacing means, at least one housing adjustably attached to the discharge plate, and at least one media chamber fluidly connected with the discharge plate. The drive means rotates the shaft. The discharge plate has at least one discharge hole formed therein. The media chamber is fluidly connected to the discharge hole of the discharge plate.

The system further comprises a line having an end fluidly connected to the media chamber where the line has an opposite end connected to the discharge plate, a plurality of support brackets attached to the media chamber, a recycling dome attached to the plurality of support brackets, another line fluidly connected to the media chamber, at least one valve located along the other line, a pump attached to an end of the shaft opposite the drive means, a support attached to the drive means, and a float attached to the support.

The displacing means is positioned within the housing. The housing is in spaced relation with the discharge plate. The housing has a configuration suitable for creating a turbulence of fluids adjacent the displacing means. The housing comprises a top restrictor, a sidewall positioned adjacent the top restrictor, and a bottom restrictor positioned adjacent an end of the sidewall opposite the top restrictor.

The media chamber is fluidly connected with an interior of the housing. A line connects to the media chamber. The line also connects to the interior of the housing.

The drive means and shaft can be oriented in any direction suitable for forming mini microbubbles in a given liquid. The depth of the drive means, shaft, displacing means, and housing can be adjusted so as to create appropriate pressure for mini microbubble formation.

DETAILED DESCRIPTION OF THE INVENTION

Figure 1:
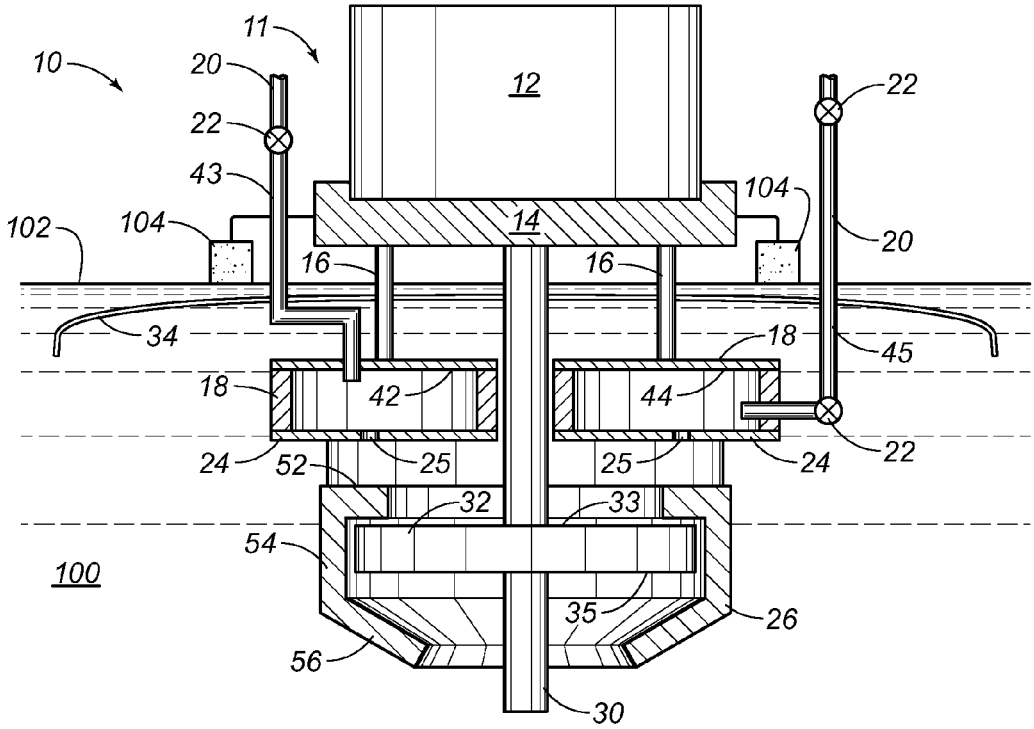
FIG. 1 shows a side cross-sectional view of the preferred embodiment of the system.

Referring to FIG. 1, there is shown a side cross-sectional view of the preferred embodiment of the system 10 of the present invention. The system 10 has a drive means 11. The drive means 11 is preferably a fractional horsepower electrical motor 12. When in the orientation shown in FIG. 1, the motor 12 sits on a support 14. A shaft 30 is attached to the motor 12 and extends vertically downwardly into the liquid 100. Numerous other methods can be used to power shaft 30, such as various types of electrical, pneumatic, hydraulic and wind powered motors that have been combined with direct, belt, chain and magnetic drives. The support 14 is held above the surface 102 of the liquid 100 by floats 104. The shaft 30 is almost entirely submerged in the liquid 100. The media chamber 18 has a first media chamber 42 and a second media chamber 44. The first and second media chambers 42 and 44 are attached to the support 14 by support brackets 16. The first and second media chambers 42 and 44 are directly connected to the discharge plates 24. Media in the media chamber 18 flows directly from the interior of the media chamber 18 through discharge holes 25 of the discharge plates 24. That is, the bottom of the first media chamber 42 and the bottom of the second media chamber 44 is the discharge plate 24 itself. Media is supplied to the media chamber 18 by lines 20. Particularly, line 43 of the lines 20 supplies media to first media chamber 42, and line 45 of the lines 20 supplies media to second media chamber 44. Lines 20 can have valves 22 placed thereon so as to regulate the flow of media from a media supply (not shown) to the first and second media chambers 42 and 44 of the media chamber 18.

The displacing means 32 is located below the discharge plate 24 on the shaft 30. The displacing means can be any suitable device for displacing a liquid and mixing it with a media. For example, the displacing means 32 can be an impeller, a propeller, or a louvered disc. A housing 26 is positioned around the displacing means 32. The housing 26 has a configuration that creates a turbulent flow of media and liquid in proximity of the displacing means 32 within the housing 26. The housing 26 is adjustably attached to the discharge plate 24 in spaced relation to the discharge plate 24. That is, the housing 26 can be moved towards or away from the discharge plate 24 so as increase or decrease a distance therebetween so as to optimize mini microbubble formation in the system 10. A recycling dome 34 is positioned above the media chamber 18 in the fluid 100 so as to catch large bubbles and recycle them back through the system 10 so as to create mini microbubbles.

Referring still to FIG. 1, the system 10 is supported by the floats 104. Moreover, the motor 12 is above the surface 102 of the liquid 100. The present invention contemplates that the motor 12 can be submerged below the surface 102 of the liquid 100. The present invention contemplates that the shaft 30 can extend at any angle in relation to the motor 12. The system 10 can be above the surface 102, partially submerged, or completely submerged within the liquid 100.

The displacing means 32 has a first side 33 and a second side 35. The rotation of the displacing means 32 about the axis of the shaft 30 causes fluid displacement in the area between the discharge plate 24 and the displacing means 32 and causes a partial vacuum pressure to exist in that area, called the equalization area.

The adjustable and configurable housing 26 is in proximity of the discharge plate 24. The housing 26 surrounds the displacing means with inlet and outlet controls and regulates liquid flow. The housing 26 may be adjusted to any position relative to the discharge plate 24 so as to reach a specific bubble control objective for its corresponding depth. The equalization area is further described by the space bounded by the area within and below the housing 26 and the distance between the discharge plate 24 and the first side 33 of the displacing means. The housing 26 has a top restrictor 52, a sidewall 54, and a bottom restrictor 56. The shape of the housing 26 around the displacing means 32 provides an enclosure that has significant control and impact on the resulting bubble control. Most often a shape is similar to that of the cross section of the displacing means 32 so as to produce optimal results. The housing 26 of FIG. 1 could also be shaped to be a simple cylindrical housing with a top restrictor 52 to restrict inflow, but with no bottom restrictor. Changing the angle of the top restrictor 52 with respect to the side wall 54 of the cylinder-shaped housing 26 creates a backpressure against the liquid discharge by adjusting the percent closed. This interaction using back pressure against the displacement can also cause more lateral discharge. The circulating axial vortices re-process larger bubbles into smaller ones. A simple ninety-degree baffle has provided an adequate result; however, a more refined angular approach can yield a better result with less energy expended. The desired angle depends on the liquid, media, and relation of the various components of the system 10.

A recycling dome 34 positioned above the displacement means 32 and housing 26 captures larger, more buoyant bubbles as they rise, returning and reprocessing them in the system 10. The recycling dome 34 can be curved or straight so long as it can contain captured bubbles below its cover. A simple connection to the top of this dome 34 allows the collected gas to be returned. This feature is especially effective in producing a greater quality and quantity of mini microbubbles and it is simple, effective, easy and inexpensive to implement.

Figure 2:
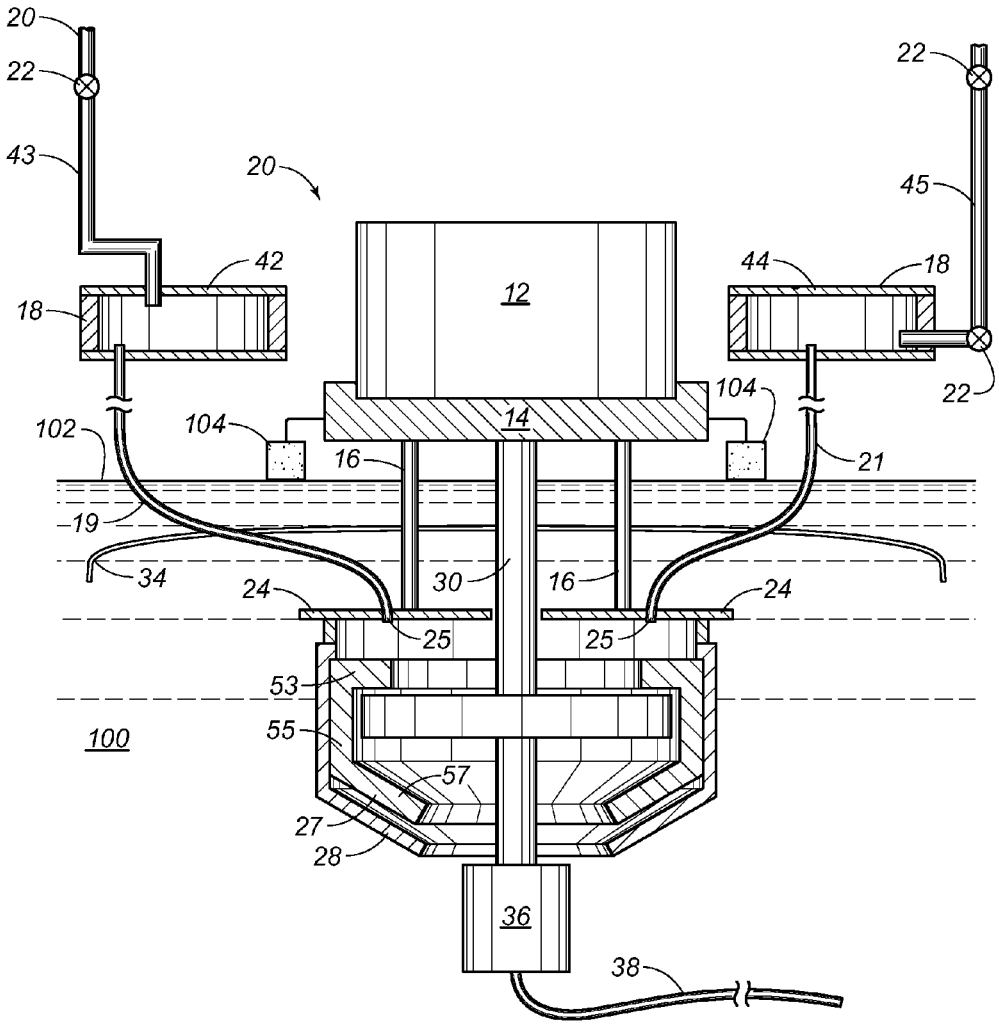
FIG. 2 shows a side cross-sectional view of an alternative embodiment of the system.

Referring to FIG. 2, there is shown a side cross-sectional view of an alternative embodiment of the system 10 of the present invention. The present invention contemplates that several housings can be used, such as a second housing 27 nested in a first housing 28. By nesting two housing 28 and 27, a simple large-bubble recycling provision can be established. The outer double wall circulation mimics the inner circulation, and large bubbles are more easily returned for reprocessing. The second housing 27 has a top restrictor 53, a sidewall 55, and a bottom restrictor 57. The top restrictor 53 in FIG. 2 extends transverse to the sidewall 55, but as discussed for the top restrictor 52 and sidewall 54 in FIG. 1 above, the angle between the top restrictor 53 and the sidewall 55 can be adjusted to an angle depending on the circumstances. The shape of the first housing 28 resembles the shape of the second housing 27 in FIG. 2 so that the second housing 27 is nested within the first housings 28.

A pump 36 can be attached to the shaft 30. The pump 36 has an inlet positioned near the housings 27 and 28 so as to receive mini microbubbles and an outlet capable of directional adjustment. The outlet of the pump 36 can be directional so as to pump mini microbubbles in a desired direction in the liquid 100. A line 38 connected to the outlet of the pump 36 gives the system 10 the ability to deliver mini microbubbles to a location remote from the system 10.

As can be seen in FIG. 2, the first media chamber 42 and the second media chamber 44 of the media chamber 18 are remotely located from the system 10. The media chambers 42 and 44 have media therein and are connected to a media supply by lines 43 and 45, respectively. Additional line 19 connects the remotely-located first media chamber 42 to the discharge plate 24. Additional line 21 connects the remotely-located second media chamber 44 to the discharge plate 24. Line 19 delivers media from the first media chamber 42 to the discharge holes 25 in the discharge plate 24. Thus, the first media chamber 42 is indirectly connected to the discharge plate 24. Line 21 delivers media from the second media chamber 44 to the discharge holes 25 in the discharge plate 24. Thus, the second media chamber 44 is indirectly connected to the discharge plate 24.

Figure 3:
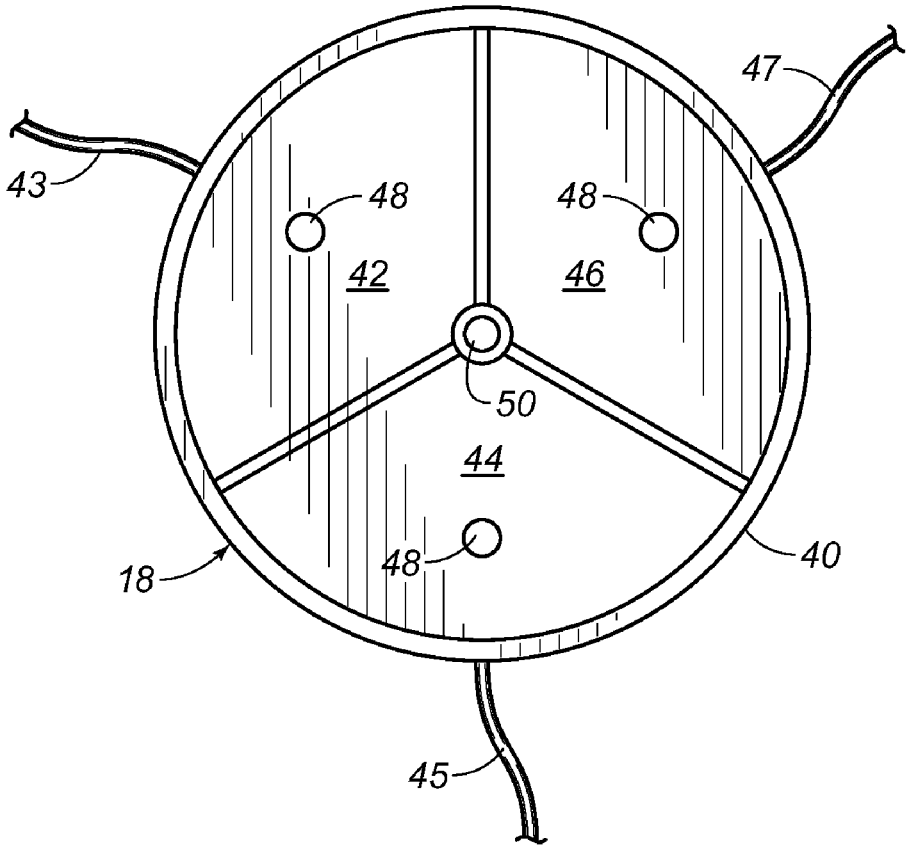
FIG. 3 shows a plan view of an alternative embodiment of the media chambers of the system.

Referring to FIG. 3, there is shown a plan view of an alternative embodiment of the media chambers 18 of the present invention. A single structure 40 has a first chamber 42, a second chamber 44, and a third chamber 46. Even though three chambers 42, 44, and 46 are shown in FIG. 3, any number of media chambers 18 can be used to fulfill a variety of functions and objectives. Each chamber 42, 44, and 46 has its own media outlet connection 48. Similarly the first chamber 42 has a line 43 connecting the chamber 42 to a media supply. The second chamber 44 has a line 45 connecting the chamber 44 to a media supply. The third chamber 46 has a line 47 connecting the chamber 46 to a media supply. The structure 40 can be positioned so that the shaft 30 runs through a center 50 of the structure 40. Other configurations of chambers are entirely possible, especially considering the possibility that the chambers 42, 44, and 46 can be made separately and remotely located from the discharge plate 24 of the system 10. It is possible that the structure 40 can be stacked upon other similar structures so that the number of media available from chambers in the structures is multiplied. Thus, the use of four media chambers 18 for separate aeration, microbe infusion, nutrient release and real time partial vacuum monitoring could simultaneously accomplish four different configuration requirements simultaneously. By separately providing and controlling a media supply and subsequently monitoring and adjusting their feed rates based on real time operating conditions, this invention can easily adjust to a variety of conditions and provide the beneficial result of monitoring, controlling and dispensing media.

Figure 4:
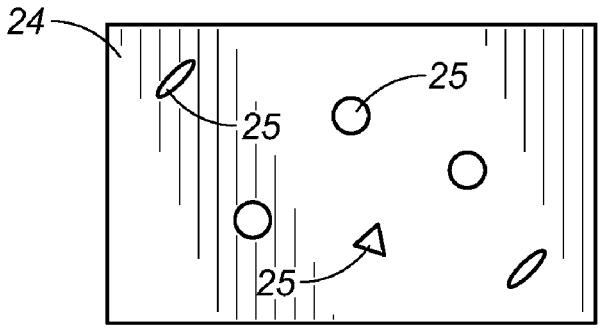
FIG. 4 shows a plan view of the discharge plate of the system.

Referring to FIG. 4, there is shown a plan view of the discharge plate 24 of the present invention. The discharge plate 24 has a number of discharge holes 25 formed therein for receiving media from the media chambers 18. As can be seen, the discharge holes 25 can be formed of any geometrical shape, including circles, slots, and triangles. The size of the discharge holes 25 can also vary. The shape and size of the discharge holes 25 depends on the liquid and media used while mixing using the system 10 of the present invention. The shape and size of the discharge plate 24 can also be changed according to the needs of the system 10.

Figure 5:
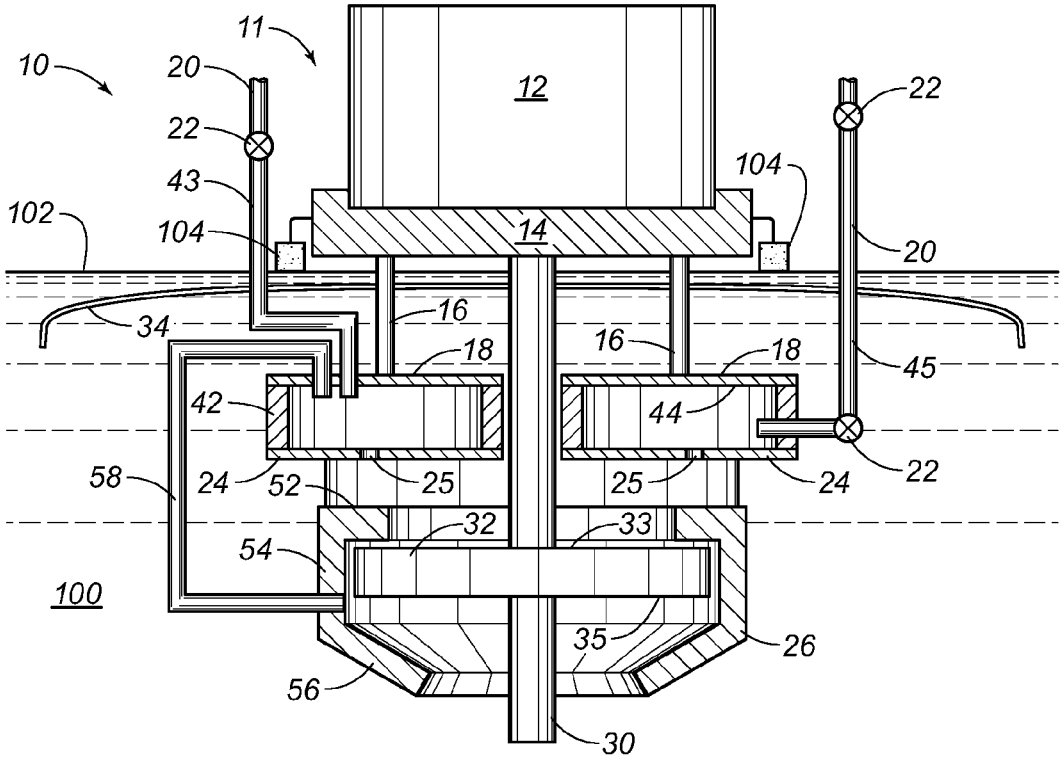
FIG. 5 shows a side cross-sectional view of another alternative embodiment of the system, with an optional partial vacuum relief line.

Referring to FIG. 5, there is shown a side cross-sectional view of another alternative embodiment of the system 10, with an optional partial vacuum relief line 58. The line 58 fluidly connects the first media chamber 42 with the interior of the housing 26. This configuration can help control the inflow and outflow of liquid 100 with respect to the displacing means 32. This configuration can also manipulate the internal flow patterns of liquid 100 around the displacing means 32. Circulation of liquid 100 around the tip of the rotating displacing means 32 behaves in ways similar to the ground effect experienced by airfoils. When moving gases (or liquids) are presented near a fixed surface, disruption of naturally occurring vortices causes pressure differentials. This effect within the housing 26 can be used to control the cavitations and shear forces at work to atomize any media present in the form of gases, liquids or solids. By adjusting to the shape and type of the displacing means 32, the production of a selectable variety of consistent bubble sizes can be achieved, especially the sizes for mini microbubbles.

The area near the housing 26 is often the area of greatest partial vacuum activity. An optional connection to the side wall 54 of the housing 26 can provide an additional source of available partial vacuum pressure from the chamber 18. Such a connection to the housing 26 also permits an additional point of vacuum relief. The optional connection can also be placed in the top restrictor 52 of the housing 26 or the bottom restrictor 56 of the housing 26. There is often abundant partial vacuum present, that when connected to a chamber 18, can be used to assist in other media transfers or even recycle foam. Foam often occurs in biological treatments and is a problem if not a nuisance. A simple surface floating collector can be connected to any one of the partial vacuum sources. The foam can be collected, combined with a foam retardant, and recycled back under water as just another multiple mixed media.

The system 10 of the present invention is novel because adjusting the system 10 for bubble quality (e.g. predominant size) and quantity (e.g. collective gas volume) can be conveniently achieved in a number of ways. First, the distance between the housing 26 and the discharge plate 24 can be adjusted. The distance between the housing 26 and the discharge plate 24 defines the equalization area where media is mixed with the liquid due to the turbulence created by the displacing means 32. It is at the depth in this area that bubbles form and then are released into the liquid through the discharge holes 25. The seemingly instantaneous collapse, or invacination, of bubbles to a point of pressure equalization is in direct response to the pressure of the liquid in the equalization area. Invacination is the process by which a gas is introduced into a liquid, and specifically refers to the point when the pressure inside a bubble equals the pressure of the liquid surrounding the bubble. The media passing through the discharge holes 25 below the surface 102 of the liquid 100 into the equalization area presents a unique opportunity to control ultimate bubble size. The milky appearance of resulting mini microbubbles is an example of such control. The gap between the housing 26 and the discharge plate 24 is a primary lateral point of release for the liquid entrained with mini-micro bubbles. Lateral release in this particular area can be useful and desirable for other reasons such as added mixing, excluder purging and directional discharging and recovery to and from remote areas.

Second, the depth of deployment of the system 10 below the surface 102 of the liquid 100 can be adjusted. Third, the operating position of the motor 12, e.g. vertically down, vertically up, horizontal, angled, whether floating or fixed mounted, can be adjusted. At a given depth, the media flow and partial vacuum must be adjusted to reach a desired bubble size. At any time, by inserting a temporary transparent connection {e.g. clear tubing) from the media inlet supply line connected to a reservoir compartment into the liquid and measuring the change in inches of the water inside the connection tube, the partial pressure can be measured in real time. Using this simple partial pressure observation, adjusting the air inflow and the corresponding water inflow and outflow, the desired partial vacuum range can be selected and adjusted until the desired bubble size generated. Further refined adjustments to airflow outlet and liquid inlet settings can achieve optimum results. The real time view of the partial vacuum pressure enables simple adjustment to be made to reach a desirable operating condition. Fourth, different configurations of the displacing means 32 can be used. Fifth, the location of the media chambers 18 can be near the system 10 as shown in FIG. 1 or remote from the system 20 as shown in FIG. 2.

Another feature is that, under normal operation of a system like the system 10, one would expect that the flow of liquid and media, once mixed, would flow from the equalization area, into the housing 26, past the displacing means 32, and out of the housing 26 away from the system 10. Unexpectedly, the flow of the liquid 100 using the present invention is unexpected and opposite of normal expectations. Due to dynamic fluid forces of the media and liquid 100 interactions, it has been observed that a counter flow, or secondary flow, into the housing 26 from underneath the system 10 occurs with the system 10 of the present invention. The liquid and media mixture flows primarily from the bottom of the housing 26, past the displacing means 32, and laterally outwardly through the equalization area. This unexpected flow is the liquid 100 reaction to the configuration of the systems 10 and 20. The liquid does flow in the expected direction, but only secondarily and not primarily. Moreover, the counterintuitive reverse flow of liquid 100 through the system 10 of the present invention better mixes the liquid 100 with media so as to create a higher quality mini microbubble.

The various embodiments of the system shown in FIGS. 1 through 5 can be combined as needed. For example, the present invention also contemplates a system with more than one housing and a partial-vacuum line extending from the media chamber to the housings. Also, the media chamber can be located near the system or remotely therefrom while the system has a single housing or multiple housings of any configuration.

The foregoing disclosure and description of the invention is illustrative and explanatory thereof. Various changes in the details of the illustrated construction can be made within the scope of the claims without departing from the true spirit of the invention. The present invention should be limited only by the following claims and their legal equivalents.

I claim:

1. A system for forming mini microbubbles comprising:
a drive means;
a shaft attached to the drive means, said drive means for rotating said shaft;
a displacing means attached to said shaft, said displacing means for mixing a media with a liquid;
a discharge plate positioned adjacent said displacing means;
at least one housing positioned below said discharge plate; and
at least one media chamber fluidly connected with said discharge plate.

2. The system of claim 1, said discharge plate having at least one discharge hole formed therein.

3. The system of claim 2, the media chamber being fluidly connected to said discharge hole of said discharge plate.

4. The system of claim 3, further comprising:
a line having an end fluidly connected to the media chamber, said line having an opposite end connected to the discharge plate.

5. The system of claim 1, further comprising:
a plurality of support brackets attached to the media chamber; and
a recycling dome attached to said plurality of support brackets.

6. The system of claim 1, said displacing means being positioned within the housing.

7. The system of claim 6, the housing being in spaced relation with said discharge plate.

8. The system of claim 6, the housing having a configuration suitable for creating a turbulence of fluids adjacent said displacing means.

9. The system of claim 8, the housing comprising:
a top restrictor; and
a sidewall positioned adjacent said top restrictor.

10. The system of claim 9, the housing further comprising:
a bottom restrictor positioned adjacent an end of said sidewall opposite said top restrictor.

11. The system of claim 1, further comprising:
a line fluidly connected to the media chamber; and
at least one valve located along said line.

12. The system of claim 1, the media chamber having an interior fluidly connected with an interior of the housing.

13. The system of claim 12, further comprising:
a line connected to the media chamber, said line being connected to said interior of said housing.

14. The system of claim 1, further comprising:
a pump attached to an end of said shaft opposite the drive means.

15. The system of claim 1, further comprising:
a support attached to the drive means; and
a float attached to the support.

16. A system for forming mini microbubbles comprising:
a drive means;
a shaft attached to the drive means, said drive means for rotating said shaft;
a displacing means attached to said shaft, said displacing means for mixing a media with a liquid;
a discharge plate positioned around said shaft between said drive means and said displacing means;
at least one housing positioned around said displacing means; and
a media chamber fluidly connected with said discharge plate.

17. The system of claim 16, the media chamber being positioned between said drive means and said discharge plate.

18. The system of claim 17, the media chamber being positioned around said shaft.

19. The system of claim 16, the media chamber comprising:
a first media chamber;
a second media chamber connected to said first media chamber; and
a third media chamber connected to said first and second media chambers.

20. The system of claim 16, further comprising:
a plurality of support brackets attached to the media chamber;
a mounting bracket attached to said plurality of support brackets; and
a recycling dome attached to said plurality of support brackets.

* * * * *